United States Patent [19]

Ueda

[11] Patent Number: 4,894,304

[45] Date of Patent: Jan. 16, 1990

[54] PHOTOSENSITIVE MEMBER WITH MAGNESIUM FLUORIDE DISPERSED IN TRANSPARENT PROTECTIVE RESIN LAYER

[75] Inventor: Hideaki Ueda, Osaka, Japan

[73] Assignee: Minolta Camera Kabushiki Kaisha, Osaka, Japan

[21] Appl. No.: 267,295

[22] Filed: Nov. 4, 1988

[30] Foreign Application Priority Data

Nov. 6, 1987 [JP] Japan ..... 62-281788

[51] Int. Cl.[4] ..... G03G 5/14; G03G 5/04

[52] U.S. Cl. ..... 430/58; 430/66

[58] Field of Search ..... 430/65, 66, 84, 58

[56] References Cited

U.S. PATENT DOCUMENTS

| | | | |
|---|---|---|---|
| 3,895,136 | 7/1975 | Makishima et al. | 427/257 |
| 3,992,091 | 11/1976 | Fisher | 355/15 |
| 4,134,763 | 1/1979 | Fujimura et al. | 427/76 |
| 4,148,637 | 4/1979 | Kubota et al. | 428/447 |
| 4,242,433 | 12/1980 | Kuehnle et al. | 430/67 |
| 4,382,118 | 5/1983 | Oka | 430/58 |
| 4,409,309 | 10/1983 | Oka | 430/65 |
| 4,426,435 | 1/1984 | Oka | 430/132 |
| 4,514,483 | 4/1985 | Matsuura et al. | 430/84 |
| 4,634,648 | 1/1987 | Jansen et al. | 430/84 |
| 4,687,723 | 8/1987 | Ohshima et al. | 430/65 |
| 4,740,440 | 4/1988 | Honda et al. | 430/60 |
| 4,770,966 | 9/1988 | Kazama et al. | 430/66 |

FOREIGN PATENT DOCUMENTS

| | | |
|---|---|---|
| 51-56635 | 5/1976 | Japan . |
| 53-92133 | 8/1978 | Japan . |
| 56-144433 | 11/1981 | Japan . |
| 58-59454 | 4/1983 | Japan . |

*Primary Examiner*—John L. Goodrow

*Attorney, Agent, or Firm*—Burns, Doane, Swecker & Mathis

[57] ABSTRACT

This invention provides photosensitive member with a transparent protective resin layer formed on a photoconductive layer formed over an electrically conductive substrate, wherein the transparent protective resin layer comprises magnesium fluoride of 1 μm or less in maximum particle size and of 0.1 μm or less in mean particle size dispersed in resin at the content of 5–60 % by weight to the resin, and the protective layer of the invention protects a photoconductive layer effectively without the deterioration of the sensitivity of the photoconductive layer.

6 Claims, No Drawings

PHOTOSENSITIVE MEMBER WITH MAGNESIUM FLUORIDE DISPERSED IN TRANSPARENT PROTECTIVE RESIN LAYER

BACKGROUND OF THE INVENTION

This invention relates to a photosensitive member with a transparent protective resin layer formed on a photoconductive layer formed over an electrically conductive substrate.

As to a conventional photosensitive member used in a copier for electrophotography, the one which has a photoconductive layer formed on an electrically conductive substrate as an image-forming surface, is generally used. When such a photosensitive member is used repeatedly for a long time, there arises such a trouble that the properties of photoconductive layer are deteriorated because of various influences on the surface of the photosensitive member. For example, when the surface of a photoconductive layer is charged repeatedly for a long time with a corona-charger etc. in order to charge a photoconductive member, there arises such a trouble that image qualities are deteriorated because of gradual oxidation by ozone on the surface of the photoconductive layer.

On the other hand, residual toners adhered to the surface of a photoconductive layer are removed by rubbing the surface of the photoconductive layer with a brush or a blade cleaner. The repetition of rubbing brings about such a trouble that the surface of a photoconductive layer is damaged or a photoconductive layer is shaved gradually to get thin. In particular, a blade cleaner which presses the surface of a photoconductive layer causes the so called "filming phenomenon" that toners are buried in the photoconductive layer. Accordingly the life of a photosensitive member is shortened much more.

There is also such a trouble that the properties of a photoconductive layer are much deteriorated by influences of humidity changes.

Therefore, a transparent protective layer is formed on a conventional photoconductive layer in order to protect the photoconductive layer. Needless to say, the transparent protective layer is gradually shaved by a cleaner as above mentioned. Accordingly, it is preferable that the transparent protective layer is as thick as possible so that the photoconductive layer may not be affected adversely as above mentioned.

But, the thicker the transparent protective layer is, the more the residual potential of a photosensitive member increases and fogs in copied images are generated. The reason for the trouble is that the transparent protective layer itself is usually made of resin and has a high electrical volume resistance.

Therefore, the electrical volume resistance of a protective layer was tried to be decreased with various ideas so that the protective layer may be thick without the increase of the residual potential.

Japanese Patent Kokai No. 157748/1980, for example, discloses a protective layer wherein aromatic amine compounds and organic protic acid are dispersed in resin for the formation of the protective layer. These compounds dispersed in the resin, although, are liable not only to be affected by humidity but also to be deteriorated by ozon, and that there is also such a trouble that those compounds can't be contained so much in the resin.

Japanese Patent Kokai No. 30847/1982 discloses a protective layer wherein metal oxide such as zinc oxide and titanium oxide is incorporated in resin for the formation of the protective layer. There was same trouble as above mentioned that this protective layer was liable to be influenced by humidity, ozon and so on.

Further, Japanese Patent Kokai No. 59454/1983 discloses a protective layer comprising $ZrO_2$, $MgF_2$, $Si_3N_4$ and so on, which is formed on a photoconductive layer by a sputtering method or vapour-depositing method. But, this protective layer is formed in accordance with the shape of the surface of a photoconductive layer. Accordingly, if the surface of the photoconductive layer is uneven, the protective layer becomes irregular. Therefore, there arises such a trouble that toners can't be removed completely by cleaning and linear noises are occurred in copied images because of the poor surface conditions for a photoconductive member.

SUMMARY OF THE INVENTION

The object of the invention is to provide a photosensitive member with a protective layer on a photoconductive layer wherein the protective layer can have a wide range of electrical volume resistance, the thickness of th protective layer can be made thick without the increase of the residual potential, the protective layer is excellent in mechanical strength and that the formation of the protective layer does not result in the deterioration of optical properties.

The present invention relates to a photosensitive member with a transparent protective resin layer formed on a photoconductive layer formed over an electrically conductive substrate, wherein the transparent protective resin layer comprises magnesium fluoride of 1 μm or less in maximum particle size and of 0.1 μm or less in mean particle size dispersed in resin at the content of 5–60 % by weight to the resin.

DETAILED DESCRIPTION OF THE INVENTION

A photosensitive member of the invention has a transparent protective resin layer comprising magnesium fluoride formed on the surface of a photoconductive layer formed over an electrically conductive substrate.

A transparent protective resin layer comprising magnesium fluoride is low in an electrical volume resistance because of the electroconductivity of magnesium fluoride, therefore the protective layer can be made thick without the increase of residual potential.

On the other hand, a protective layer is obtained which is stable for a long time and doesn't deteriorate the optical properties of a photosensitive member, because the properties of magnesium fluoride are not changed by ozon generated by corona-charging, temperature, humidity etc.

Further, a transparent protective resin layer comprising magnesium fluoride has an adequate lubricity, improved cleaning properties, improved wear resistance, and excellent durability.

In addition, when such a protective layer as above mentioned is applied to a copier for electrophotography which utilizes coherent laser light, the laser light irradiated into a phtosensitive member doesn't interfere with reflected light from the electrically conductive substrate because it is diffused in the protective layer, therefore stripe irregulalities in copied images are not generated.

Before magnesium fluoride is incorporated in a transparent protective resin layer, magnesium fluoride is ground finely to be preferably 1 μm or less in maximum particle size, and 0.1 μm or less, more preferably 0.05 μm or less in mean particle size. If the maximum particle size is bigger than 1 μm, the smoothness of the protective layer may be poor and results in noises in copied images. If the mean particle size is bigger than 0.1 μm, poor dispersibility of magnesium fluoride in a coating solution for the formation of a protective layer results in easy aggregation and settling of magnesium fluoride and causes noises in copied images. The settling of magnesium fluoride results in the poor stability of a coating solution, which affect adversely continuous coating. In addition, translucence of the protective layer itself becomes poor to lower the sensitivity.

It is preferable to contain magnesium fluoride at the content within the range of between 5–60% by weight to resin for the formation of a protective layer. If the content of magnesium fluoride is less than 5% by weight, the electrical volume resistance of the protective layer does not lower so much. If the content is more than 60% by weight, there arises troubles in the translucence of a protective layer and the hardness.

The formation of a transparent protective resin layer containing magnesium fluoride formed on a photoconductive layer comprises grounding finely magnesium fluoride as above mentioned, applying the dispersion solution of the magnesium fluoride diluted with a solvent onto a photoconductive layer by general coating methods such as a spray method and a dipping method in order to incorporate the magnesium fluoride at above mentioned content in resin, and then drying the coating layer. It is preferable that magnesium fluoride is contained so that the electrical volume resistance may be within the range of between $10^8$–$10^{13}$ Ω·cm from the viewpoint of the prevention of the increase of residual potential.

It is desirable to form a protective layer of 0.5–15 μm in thickness. If the thickness is thinner than 0.5 μm, the role of the protection can not be taken sufficiently. If the thickness is thicker than 15 μm, there arise such troubles as the increase of residual potential, the lowering of transmission and the deterioration of sensitivity.

Further, other low-electrically resistant materials per se known, and/or additives such as dispersants and plasticizers may be added to a protective layer of the invention.

A resin for the formation of a protective layer is not particularly restricted, however the examples of the resin are given by one or more kinds of thermoplastic resin and/or thermosetting resin such as acrylic resin, amino resin, expoxy resin, silicon resin, fluoroplastic, polyester, vinyl resin, urethane resin, melamine resin, polystyrene resin, polyamide resin, polyvinylbutyral, nitrocellulose, cellulose acetate, alkyd resin, acrylic-melamine resin, and hardened rubber. Other resin hardened by ultraviolet-ray or X-ray may be used as well as thermosetting as above mentioned.

Any materials generally used for the charge generation may be applied to a photoconductive layer of a photosensitive member of the invention. Examples of such photoconductive layer may be a vacuum vapour deposition type of inorganic photoconductive materials such as Se, Se-As and Se-Te, a binder-type coated with a dispersed solution with photoconductive particles such as ZnO, CdS, $CdS.nCdCo_3(0 \leqq n < 4)$, $CdSSe.nCdCo_3(0 \leqq n < 4)$, phthalocyanine in binder resin or function divided type having a charge generating layer and a charge transporting layer.

A charge generating layer of a function divided type is formed by coating a dispersion solution containing charge generating materials and a binder resin followed by drying.

Examples of charge generating materials useful for the function-divided type above mentioned are organic substances such as bisazo pigments, triarylmethane dyes, thiazine dyes, oxazine dyes, xanthene dyes, cyanine coloring agents, styryl coloring agents, pyrylium dyes, azo pigments quinacridone pigments, indigo pigments, perylene pigments, polycyclic quinone pigments, bisbenzimidazole pigments, indanthrone pigments, squalylium pigments and phthalocyanine pigments; and inorganic substances such as selenium, selenium-tellurium, selenium arsenic, cadmium sulfide and amorphous silicon. Any other material is also usable insofar as it generates charge carriers very efficiently upon absorption of light.

The binder to be used is any of known thermoplastic resins or thermosetting resins having electrically insulating properties, light-curable resins and photoconductive resins. Although not limitative, examples of suitable binders are thermoplastic binders such as saturated polyester resin, polyamide resin, acrylic resin, ethylene-vinyl acetate copolymer, ion-crosslinked olefin copolymer (ionomer), styrene-butadiene block copolymer, polyallylate, polycarbonate, vinyl chloride-vinyl acetate copolymer, cellulose ester, polyimide and styrol resin; thermosetting binders such as epoxy resin, urethane resin, silicone resin, phenolic resin, melamine resin, xylene resin, alkyd resin and thermosetting acrylic resin; light-curable resins; photoconductive resins such as poly-N-vinylcarbazole, polyvinylpyrene and polyvinylanthracene; etc. These binders are usable singly or in admixture. The electrically insulating resin is preferably at least $1 \times 10^{12}$ ohm-cm in volume resistivity.

Illustrative examples of charge transporting materials are hydrazone compounds, pyrazoline compounds, styryl compounds, triphenylmethane compounds, oxadiazol compounds, carbazole compounds, stilbene compounds, enamine compounds, oxazole compounds, triphenylamine compounds, tetraphenylbenzidine, azine compounds and so on, including carbazole, N-ethylcarbazole, N-vinylcarbazole, N-phenylcarbazole, tethracene, chrysene, pyrene, perylene, 2-phenylnaphthalene, azapyrene, 2,3-benzochrysene, 3,4-benzopyrene, fluorene, 1,2-benzofluorene, 4-(2-fluorenylazo)-resorcinol, 2-p-anisolaminofluorene, p-diethylaminoazobenzene, cadion, N,N-dimethyl-p-phenylazoaniline, p-(dimethylamino)stilbene, 1,4-bis(2-methylstyryl)benzene, 4-(4-diethylaminostyrylanthracene, 2,5-bis(4-diethylaminophenyl)-1,3,5-oxadiazole, 1-phenyl-3-(p-diethylaminostyryl)-5-(p-diethylamino-phenyl)-pylazolone, 1-phenyl-3-phenyl-5-pylazolone, 2-(m-naphtyl)-3-phenyloxazole, 2-(p-diethylaminostyryl)-6-diethylaminobenzoxazole, 2-(p-diethylaminostyryl)-6-diethylaminobenzothiazole, bis(4-diethylamino-2-methylphenyl)phenylmethane, 1,1-bis(4-N,N-diethylamino-2-ethylphenyl)heptane, N,N-diphenylhydrazino-3-methylidene-10-ethylpheoxazine, N,N-diphenylhydrazino-3-methylidene-10-ethylphenothiazine, 1,1,2,2-tetrakis-( 4-N,N-diethylamino-2-ethylphenyl)ethane, p-diethylaminobenzaldehyde-N,N-diphenylhydrazone, p-diphenylaminobenzaldehyde-N,N-diphenylhydrazone, N-ethylcarbazole-N-methyl- N-phenylhydrazone, p-diethylaminobenzaldehyde-N-α-naphthyl-N-phenylhydrazone, p-diethylaminobenzaldehyde-3-methylbenzothiazolinone-2-hydrazone, 2-methyl-4-N,N-diphenylamino-β-phenylstilbene, α-phenyl-4-N,N-diphenylaminostilbene and so on. Any of these charge transporting materials can be singly or in combination with other resin.

A charge transporting layer is formed by applying a solution containing a charge transporting material and a binder resin above mentioned dissolved in a solvent onto the above obtained charge generating layer followed by drying to form a photoconductive layer of a function divided type. The thickness of the layer is generally 10–60 μm.

A photosensitive member thus formed may have an intermediate layer between a substrate and a photoconductive layer. Suitable examples used for the formation of this layer are polymer itself such as polyimide, polyamide, nitrocellulose, polyvinyl butyral, and polyvinyl alcohol, which may contain dispersed low electrically conductive materials such tin oxide or indium oxide, or a vapour deposited layer of aluminium oxide, zinc oxide or silicon oxide etc. It is preferable that the thickness of the layer is 1 μm or less.

Any electrically conductive substrates used generally may be applied to a photosensitive member of the invention. There are exemplified by sheets or drums which are formed by processing foils or plates of copper, aluminium, silver, iron, nickel and so on, or plastic films on which metals above mentioned are vapor-deposited in vacuum or adhered by means of electroless plating. Furthermore, there are exemplified by plastic films and paper with conductive layers which are formed by applying electrical conductive materials such as conductive polymers, indium oxide, tin oxide with an adequate binder, or by vapor-depositing these conductive materials.

This invention is explained by examples, which make it clear that the examples according to the invention are superior to comparative examples.

EXAMPLES 1–4

An aluminium substrate was used as an electrically conductive substrate in the examples.

First, 50 parts by weight of copper-phthalocyanine and 0.2 part by weight of tetranitro-copper-phthalocyanine were dissolved in 500 parts by weight of concentrated sulfric acid (98%) with enough stirring. The obtained solution was added to 5000 parts by weight of water to deposit a photoconductive composition containing copper-phthalocyanine and tetranitro-copper-phthalocyanine, followed by filtering the composition, rinsing them and drying them at 120° C. in vacuum.

Then, 10 parts by weight of the above-obtained photoconductive composition, 22.5 parts by weight of thermosetting acrylic resin (Acrydick A 405; produced by Dainippon Ink K.K.), 7.5 parts by weight of melamine resin (Super Beckamine J820; produced by Dainippon Ink K.K.), 15 parts by weight of styryl compound represented by the following formula (I) were placed into a ball mill pot together with 100 parts by weight of the mixed solvent of methyl ethyl ketone with xylene (1:1), and treated for 48 hours for dispersion to obtain a photosensitive coating solution, which was then applied onto the aluminium substrate and dried to form a photoconductive layer of 15 μm in thickness.

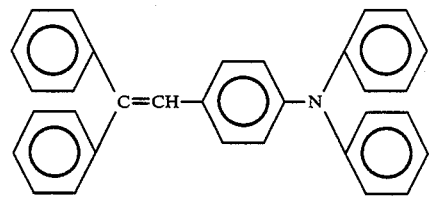

(I)

And then, a transparent protective resin layer containing magnesium fluoride was formed on the resultant photoconductive layer, as below; thermosetting acrylic resin (Acrydick A 405; produced by Dainippon Ink K.K.) and melamine resin (Super Beckamine J 820; produced by Dainippon Ink K.K.) were used for the formation of the protective layer. Magnesium Fluoride, before used, were finely ground so that the maximum particle size may be 1 μm or less and mean particle size may be 0.05 μm or less.

Then, finely ground magnesium fluoride as above mentioned of 1.5 part by weight (Example 1), 3 parts by weight (Exmple 2), 6 parts by weight (Example 3), 9 parts by weight (Example 4), the above mentioned thermosetting acrylic resin of 22.5 parts and the melamine resin of 7.5 parts by weight were dispersed in xylene solvent to prepare a coating solution for a protective layer.

The obtained coating solution was spray-coated onto the photoconductive layer to form a transparent protective resin layer of about 2 μm in thickness after thermoset. Thus, photosensitive members of Examples 1–4 with a transparent protective resin layer containing magnesiun fluoride were prepared.

Magnesium fluoride were incorporated in the protective resin layer at the content of 5% by weight (Example 1), 10% by weight (Example 2), 20% by weight (Example 3), 30% by weight (Example 4) on the basis of acrylic resin-melamine resin of the protective layer.

Comparative Example 1, 2

A photosensitive member was prepared similarly as Example 1 to compare with those of Example 1–4 except that a protective layer was not formed in Comparative Example 1, and that magnesium fluoride was not contained in a protective layer in Comparative Example 2.

The photosensitive members thus prepared in Examples 1–4 and Comparative Examples 1–2 were incorporated into a commercial electrophotographic copying machine (EP-350Z, produced by Minolta Camera K.K.) and tested with charging to a voltage of +6 kv by corona-discharge to measure the initial surface potential Vo (V), the amount of exposure required for Vo to reduce to half of $V_0$ ($E_{\frac{1}{2}}$ (lux·sec)), the potential decay rate $DDR_1$ (%) when the member was allowed to stand in the dark for 1 second after charging, and the residual potential $V_R$ (V).

The results were shown in Table 1.

TABLE 1

| | Vo (V) | $E_{\frac{1}{2}}$ (lux · sec) | $DDR_1$ (%) | $V_R$ (V) |
|---|---|---|---|---|
| EXAMPLE 1 | +630 | 1.8 | 14.8 | 15 |
| EXAMPLE 2 | +620 | 1.8 | 15.3 | 12 |
| EXAMPLE 3 | +610 | 1.7 | 15.7 | 10 |
| EXAMPLE 4 | +610 | 1.7 | 16.6 | 10 |
| COMPARATIVE | +620 | 1.7 | 15.8 | 8 |

TABLE 1-continued

| | Vo (V) | $E_{\frac{1}{2}}$ (lux · sec) | $DDR_1$ (%) | $V_R$ (V) |
|---|---|---|---|---|
| EXAMPLE 1 | | | | |
| COMPARATIVE EXAMPLE 2 | +680 | 13.5 | 8.6 | 110 |

As shown in Table 1, the photosensitive members prepared in each Example, which have protective layers on photoconductive layers, show much lower $E_{\frac{1}{2}}$ and $V_R$ compared to those of the photosensitive member with a protective layer made only of acrylic-melamine resin as prepared in Comparative Example 2. And the values of $E_{\frac{1}{2}}$ and $V_R$ of the photosensitive members prepared in each Examples are almost as same as those of the photosensitive member without a protective layer as prepared in Comparative Example 1.

The photosensitive member prepared in each Example kept the values of $E_{\frac{1}{2}}$ and $V_R$ low in spite of the formation of a protective layer because magnesium fluoride was added into the protective layer. The protective layer did not cause the deterioration of sensitivity and the generation of fogs in copied images.

And then, Vo(V), $E_{\frac{1}{2}}$ (lux·sec), $DDR_1$(%) and $V_R$(V) were measured on each photosensitive member, after the photosensitive member was left under such conditions as 30° C. of temperature and 85% of relative humidity for 5 days.

The results were shown in Table 2.

TABLE 2

| | Vo (V) | $E_{\frac{1}{2}}$ (lux · sec) | $DDR_1$ (%) | $V_R$ (V) |
|---|---|---|---|---|
| EXAMPLE 1 | +610 | 1.8 | 15.2 | 13 |
| EXAMPLE 2 | +600 | 1.8 | 15.8 | 10 |
| EXAMPLE 3 | +600 | 1.7 | 16.0 | 8 |
| EXAMPLE 4 | +600 | 1.7 | 16.8 | 8 |
| COMPARATIVE EXAMPLE 1 | +540 | 1.3 | 18.5 | 7 |
| COMPARATIVE EXAMPLE 2 | +660 | 15.0 | 10.3 | 110 |

As can be understood from the results shown in Table 2, the photosensitive member prepared in each Example were excellent in humidity resistance even after it was left under highly humid conditions. On the contrary, the photosensitive member without a protective layer prepared in Comparative Example 1 showed the lowered Vo and the increased $DDR_1$.

EXAMPLE 5

An aluminium substrate was also used as an electrically conductive substrate in the example.

First, a charge generating layer was formed on the aluminium substrate.

One part by weight of metal-free phthalocyanine of ρ-type as a charge generating material, 1 part by weight of polyvinylbutyral (3 mol % or less of acetylation degree, 68 mol % of butylation degree, 1500 of polymerization degree) were placed into a ball mill pot and treated for dispersion for 24 hours to obtain a photosensitive coating solution, which was then applied onto the aluminium substrate and dried to form a charge generating layer of 0.3 μm in thickness.

Then, a hydrazone compound represented by the formula (II);

(II)

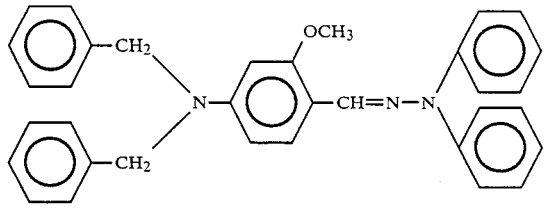

was used as a charge transporting material for the formation of a charge transporting layer on the charge generating layer.

Ten parts by weight of the above hydrazone compound, 10 parts by weight of polycarbonte resin (Panlite K-1300; produced by Teijin Kasei K.K.) were dissolved in 180 parts by weight of tetrahydrofuran solvent. The obtained solution was applied onto the charge generating layer to form a charge transporting layer of 15 μm in thickness after dried.

And then, a transparent protective resin layer containing magnesium fluoride formed on the resultant charge transporting layer a below; Polycarbonate resin was used for the formation of the protective layer. Magnesium Fluoride, before used, were finely ground so that the maximum particle size may be 1 μm or less and mean particle size may be 0.03 μm or less.

Then, finely ground magnesium fluoride as above mentioned of 2 parts of weight and 10 parts by weight of polycarbonate were dispersed in 100 parts by weight of tetrahydrofuran so that magnesium fluoride might be contained at the content of 10 percents by weight to the polycarbonate resin. The obtained dispersion solution was applied onto the charge transporting layer to form a transparent protective resin layer of about 3 μm in thickness. Thus, in Example 5, a transparent protective resin layer containing magnesium fluoride was formed on the surface of a function divided photosensitive member with a charge transporting layer formed on a charge generating layer formed over an aluminium substrate.

COMPARATIVE EXAMPLE 3, 4

A function divided photosensitive member was prepared similarly as Example 5 to compare with that of Example 5 except that a protective layer was not formed in Comparative Example 3 and that a protective layer of about 0.2 μm in thickness was formed by sputtering magnesium fluoride with high frequency of 13.56 MHz in Comparative Example 4.

The photosensitive members thus prepared in Example 5 and Comparative Examples 3–4 were incorporated into a commercial electrophotographic copying machine (EP-470Z, produced by Minolta Camera K.K.) and tested with charging to a voltage of −6KV by corona-discharge to measure the initial surface potential Vo (V), the amount of exposure required for Vo to reduce to half of Vo ($E_{\frac{1}{2}}$ (lux·sec)), the potential decay rate $DDR_1$ (%) when the member was allowed to stand in the dark for 1 second after charging, and the residual potential $V_R$ (V).

The results were shown in Table 3.

TABLE 3

| | Vo (V) | $E_{\frac{1}{2}}$ (lux · sec) | $DDR_1$ (%) | $V_R$ (V) |
|---|---|---|---|---|
| EXAMPLE 5 | −640 | 1.9 | 8.0 | 15 |
| COMPARATIVE EXAMPLE 3 | −630 | 1.9 | 9.0 | 10 |
| COMPARATIVE EXAMPLE 4 | −630 | 1.9 | 10.0 | 15 |

As shown in Table 3, the photosensitive member prepared in Example 5 kept $E_{\frac{1}{2}}$ and $V_R$ at as low values as the photosensitive member without a protective layer prepared in Comparative Example 3 and the photosensitive member with the protective layer made only of magnesium fluoride prepared in Comparative Example 4, although the photosensitive member had a protective resin layer. The protective layer did not cause the deterioration of sensitivity and the generation of fogs in copied images. And the potential decay late in the dark ($DDR_1$) was lower than those of Comparative Examples 3, 4, therefore the photosensitive member of the invention had high charge-keeping properties.

Further, photosensitive members of Example 5, Comparative Examples 3 and 4 were subjected to continuous copying test of 10000 sheets of paper to evaluate the image properties.

As a result, the photosensitive member of Example 5, showed constantly good image properties while and after the continuous copying test of 10000 sheets of paper.

To the contrary, the photosensitive member without a protective layer in Comparative Example 3 showed irregular concentration in copied images because the photoconductive layer was shaved. The photosensitive member with a protective layer made only of magnesium fluoride in Comparative Example 4 formed black lines because of poor cleaning properties after only 100 sheets of paper was developed.

As above mentioned, the surface of the photosensitive member of Example 5 was protected enough with a transparent protective resin layer to be excellent in mechanical strength such as wear resistance, and cleaning properties.

EXAMPLE 6

One part by weight of azo pigment represented by the following formula (III);

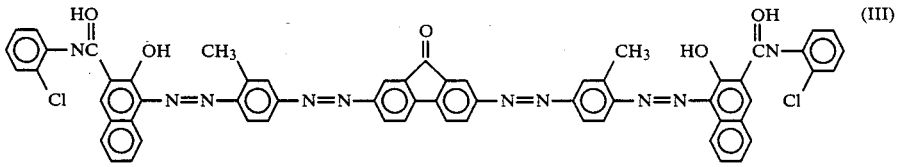

(III)

2 parts by weight of polyvinyl butyral resin (S-Lec Bx-1; produced by Sekisui Kagaku K.K.) were dispersed in 100 parts by weight of tetrahydrofuran for 24 hours by means of sand grinder to obtain a photosensitive coating solution, which applied onto an aluminium substrate to form a charge generating layer of 0.3 μm in thickness after dried.

Then, 10 parts by weight of azine represented by the following formula (IV);

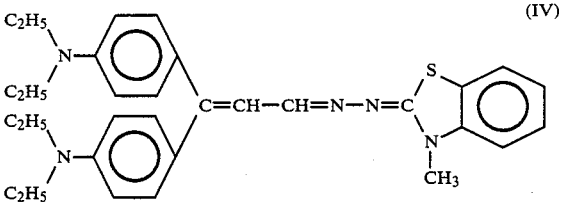

(IV)

10 parts by weight of polycarbonate resin (Polycarbonate Z; produced by Mitsubishi Gas Kagaku K.K.) were dissolved in 100 parts by weight of tetrahydrofuran. The obtained solution was applied onto the charge generating layer to form a charge transporting layer of 20 μm in thickness after dried.

And then, a transparent protective resin layer containing magnesium fluoride was formed on the resultant charge transporting layer as below; Polycarbonate resin was used for the formation of the protective layer. Magnesium Fluoride, before used, were finely ground so that the maximum particle size may be 0.1 μm or less and mean particle size may be 0.01 μm or less.

Then magnesium fluoride wa mixed for dispersion in tetrahydrofuran by means of sand mill so that magnesium fluoride might be contained at the content of 30 percents by weight to the polycarbonate resin. The obtained dispersion solution was applied onto the charge transporting layer to form a transparent protective resin layer of about 1 μm in thickness.

EXAMPLE 7

A photosensitive member was prepared similarly as Example 6 except that magnesium fluoride was mixed so that its content might be 50% by weight to the resin in Example 6.

COMPARATIVE EXAMPLE 5

A photosensitive member was prepared similarly as Example 6 except that a surface protective layer was not formd in Example 6.

COMPARATIVE EXAMPLE 6

A photosensitive member was prepared similarly as Example 6 except that magnesium fluoride was mixed so that its content might be 70% by weight to the resin in Example 6.

COMPARATIVE EXAMPLE 7

A photosensitive member was prepared similarly as Example 6 except that magnesium fluoride with maximum particle size of 1.2 μm and mean particle size of 0.17 μm was used.

COMPARATIVE EXAMPLE 8

A photosensitive member was prepared similarly as Example 6 except that conductive zinc oxide was used instead of magnesium fluoride in Example 6.

The photosensitive members thus prepared in Example 6–7 and Comparative Examples 5–8 were incorporated into a commercial electrophotographic copying machine (EP-470Z, produced by Minolta Camera K.K.) and tested with charging to a voltage of −6KV by corona-discharge to measure the initial surface potential Vo (V), the amount of exposure required for Vo to reduce to half of Vo ($E_{\frac{1}{2}}$ (lux·sec)), the potential decay rate $DDR_1$ (%) when the member was allowed to stand in the dark for 1 second after charging, and the residual potential $V_R$ (V).

The results were shown in table 4.

TABLE 3

| | Vo (V) | $E_{\frac{1}{2}}$ (lux · sec) | $DDR_1$ (%) | $V_R$ (V) |
|---|---|---|---|---|
| EXAMPLE 6 | −620 | 1.1 | 6.5 | 10 |
| EXAMPLE 7 | −610 | 1.0 | 7.0 | 8 |
| COMPARATIVE EXAMPLE 5 | −610 | 1.1 | 6.0 | 5 |
| COMPARATIVE EXAMPLE 6 | −590 | 1.4 | 8.5 | 8 |
| COMPARATIVE EXAMPLE 7 | −610 | 1.3 | 6.5 | 15 |
| COMPARATIVE EXAMPLE 8 | −600 | 1.4 | 8.0 | 15 |

Photosensitive members of Example 6, Comparative examples 5–7 were subjected to continuous copying test of 10000 sheets of paper.

Example 6; image properties were excellent

Comparative Example 5: there can be seen irregular concentration in copied images because the photoconductive layer was shaved.

Comparative Exmple 6; a few noises of black spots were observed.

Comparative Example 7; black lines were formed because of poor cleaning properties after only 1000 sheets of paper was developed.

Photosensitive members of Example 6 and Comparative Example 8 were subjected to copying test of 100 sheets of paper under such conditions as 30° C. of temperature and 85% of relative humidity.

Example 6: image properties were excellent.

Comparative Example 8: image drift occured as soon as copying test was started.

EXAMPLE 8

An amorphous selenium layer of about 60 μm in thickness was formed on an aluminium substrate by means of vapour deposition.

One hundred parts by weight of poly urethane resin (LA 4000; produced by Kansai Paint K.K.) and 40 parts by weight of magnesium fluoride powder (0.5 μm in maximum particle size; 0.02 μm in mean particle size) were placed into a ball mill pot for dispersion for 48 hours together with 100 parts by weight of Cellosolve acetate. The obtained dispersion solution was applied onto the photoconductive layer and dried to form a surface protective layer.

Then the resultant photosensitive member was installed in a commercial electrophotographic copying machine (EP-350Z; produced by Minolta Camera K.K.) and charged to the level of +6KV by corona charger to measure Vo, $E_{\frac{1}{2}}$, $DDR_1$, $V_R$.

The results was shown in Table 5.

TABLE 5

| | Vo (V) | $E_{\frac{1}{2}}$ (lx · sec) | $DDR_1$ (%) | $V_R$ (V) |
|---|---|---|---|---|
| EXAMPLE 8 | +640 | 2.6 | 9.0 | 20 |

What is claimed is:

1. A photosensitive member with a transparent protective resin layer formed on a photoconductive layer formed over an electrically conductive substrate, wherein the transparent protective resin layer comprises magnesium fluoride of 1 μm or less in maximum particle size and of 0.1 μm or less in mean particle size dispersed in resin at the content of 5–60% by weight to the resin.

2. A photosensitive member of claim 1, wherein the photoconductive layer is a monolayer type comprising a charge generating material and a charge transporting material dispersed in resin.

3. A photosensitive member of claim 1, wherein the photoconductive layer is a laminated type comprising a charge transporting layer and a charge generating layer.

4. A photosensitive member of claim 1, wherein the photoconductive layer comprises selenium.

5. A photosensitive member of claim 1, wherein the transparent protective resin layer has 0.5–15 μm in thickness.

6. A photosenstive member of claim 1, wherein the transparent protective resin layer has $10^8$–$10^{13}$ ohm·cm of an electrical volume resistance.

* * * * *